United States Patent [19]

LaVoy

[11] Patent Number: 4,897,909

[45] Date of Patent: Feb. 6, 1990

[54] METHOD FOR WHEEL MANUFACTURE BY PUNCH FORMING

[75] Inventor: Warren J. LaVoy, Morepeth, Canada

[73] Assignee: Motor Wheel Corporation, Lansing, Mich.

[21] Appl. No.: 291,551

[22] Filed: Dec. 29, 1988

[51] Int. Cl.[4] ..... B21H 1/02

[52] U.S. Cl. ..... 29/894.325; 29/802; 72/327

[58] Field of Search ..... 29/159 A, 159 R, 159.01, 29/802; 72/327, 333

[56] References Cited

U.S. PATENT DOCUMENTS

| | | | |
|---|---|---|---|
| 451,203 | 4/1891 | Turner | 72/327 |
| 3,442,110 | 5/1969 | Walton et al. | 72/327 |
| 3,688,373 | 9/1972 | Gregg | 29/159 R |
| 3,776,016 | 12/1973 | Quinn et al. | 72/327 |
| 4,279,287 | 7/1981 | Daudi et al. | 29/159 R X |
| 4,354,407 | 10/1982 | Daudi et al. | 29/159 R X |
| 4,551,122 | 11/1985 | Kraft et al. | 29/159 R X |
| 4,573,338 | 3/1986 | Daudi | 29/159 R X |
| 4,646,434 | 3/1987 | Daudi | 29/802 |
| 4,728,842 | 3/1988 | Martin | 72/327 X |
| 4,733,448 | 3/1988 | Daudi | 29/802 X |

FOREIGN PATENT DOCUMENTS

| | | | |
|---|---|---|---|
| 165531 | 12/1981 | Japan | 72/327 |

*Primary Examiner*—Timothy V. Eley
*Assistant Examiner*—Peter Dungba Vo
*Attorney, Agent, or Firm*—Barnes, Kisselle, Raisch, Choate, Whittemore & Hulbert

[57] ABSTRACT

Method for punch forming center pilot opening or other wheel mounting surfaces in a pierceable metal performed wheel disc blank mounted internally of the wheel rim. A combination pierce and shave punch forms the disc opening in a single working stroke and produces a one-piece scrap slug containing both the pierced and shaved metal removed from the disc. The punch has a correlated dimensional relationship between disc material thickness, pierce punch diameter, shave punch diameter and shave punch set back from the pierce punch. A smoother, more cylindrical and more dimensionally consistent opening surface is obtained than with conventional pierce-only punches.

15 Claims, 3 Drawing Sheets

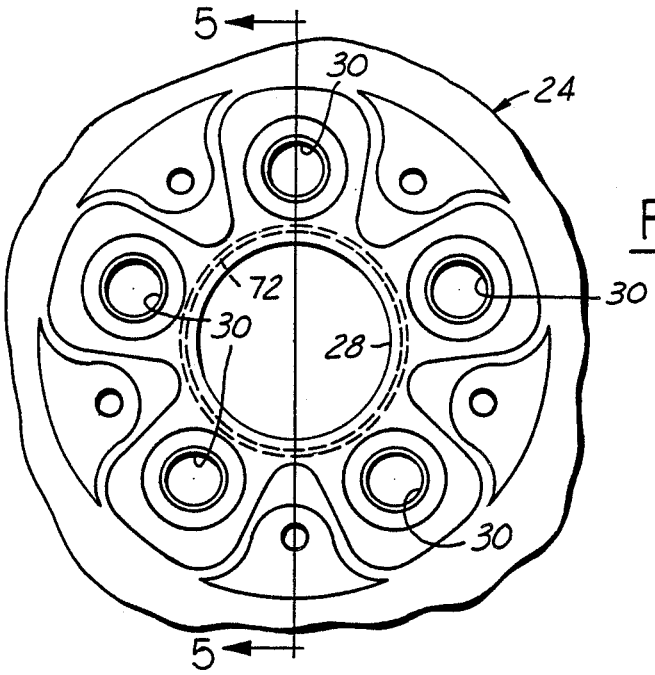
FIG.4
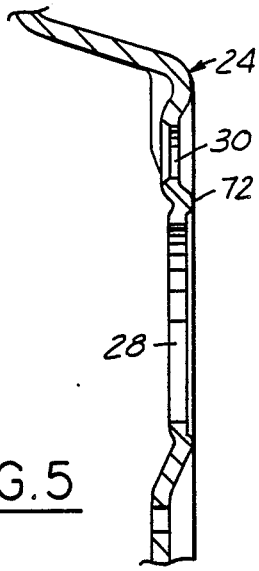
FIG.5
FIG.6
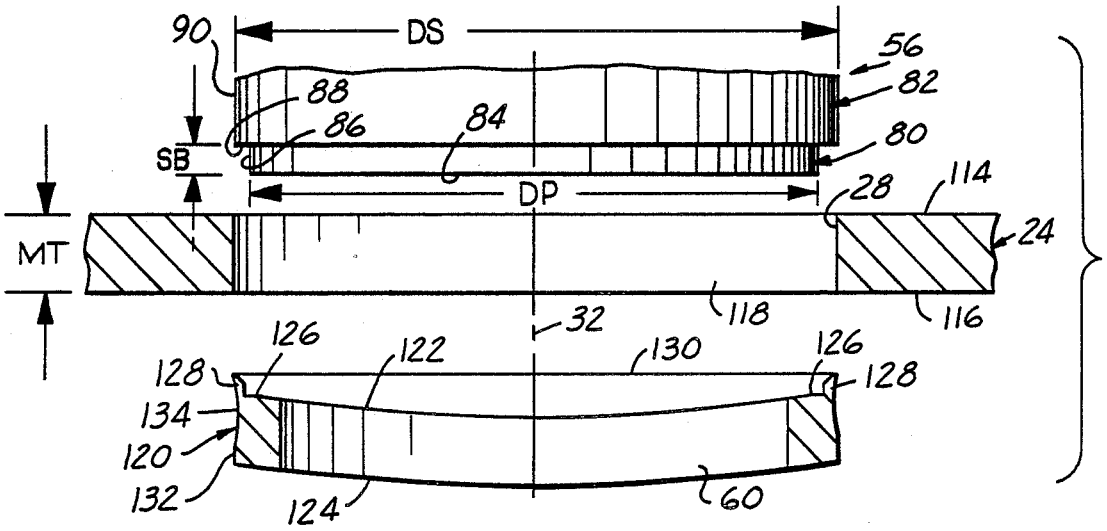
FIG.7 (PRIOR ART)
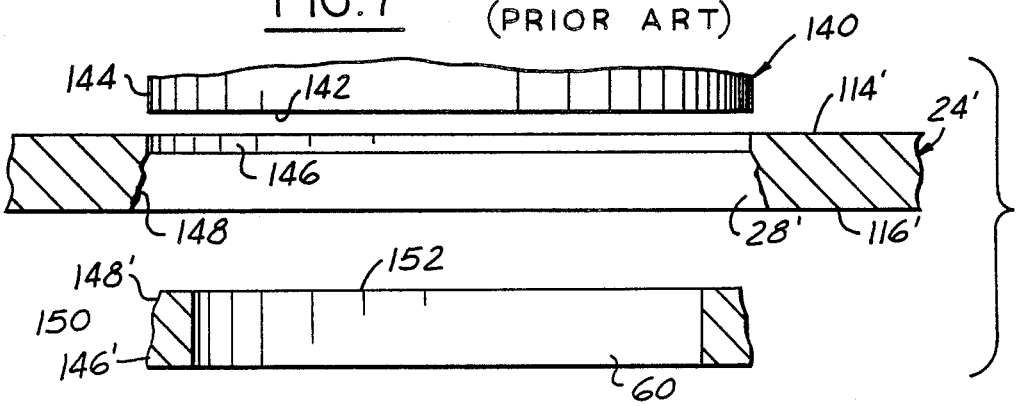

METHOD FOR WHEEL MANUFACTURE BY PUNCH FORMING

The present invention relates to the art of vehicle wheel manufacture, and more particularly to formation by metal piercing of center-pilot openings in the disc of passenger vehicle wheels made from steel or other metal plate or sheet materials.

BACKGROUND OF THE INVENTION

Passenger vehicle wheels have long been manufactured from sheet and plate steel materials wherein the rim is rolled formed to provide a drop center well type rim for receiving a tubeless pneumatic tire, and a stamped sheet metal disc (also known as a wheel body or wheel spider) is press fit into and welded to the inner periphery of the rim to complete a wheel assembly adapted for mounting to a vehicle axial spindle, hub or drum-hub. Such vehicle wheels conventionally include a circular array of disc bolt openings adpated to receive mounting studs for mounting the wheel to a vehicle, and a center-pilot opening adapted to be received over the wheel spindle.

It has been and remains conventional practice in industry to attempt to form a bolt mounting circle and center-pilot openings coaxially with each other and with the tire rim bead seats with the goal thus being a perfect true-running wheel. A number of techniques have been proposed and employed for accomplishing this result, including formation of the bolt and center openings with a single punching tool set operating on a rim and disc assembly while locating off of the bead seat, machining the center opening while locating off of the preformed bolt-mounting openings, and/or circumferentially permanently deforming the rim bead seats while locating off of the bolt-mounting and/or center pilot openings. For example, Gregg U.S. Pat. No. 3,688,373 discloses apparatus for rounding and forming vehicle wheels. It is also conventional practice in the manufacture of such wheels to machine the inside surface or ID of the rough formed center pilot opening while locating off of the bead seats to obtain concentricity between the center openings and the bead seats.

However, in manufacturing operations set up for mass production of sheet metal and plate fabricated components such as the aforementioned steel passenger vehicle wheels, it is often more economical, and in some cases more accurate, to employ metal piercing, punching and/or shaving operations to form through openings in the disc metal, such as the aforementioned bolt mounting circle and center-pilot openings in the wheel disc, rather than to form these openings by machining operations such as drilling, reaming, boring, etc. due, for example, to existing investment in stamping and punch press equipment as well as the associated facility for designing, making and maintaining the tooling for such equipment.

One example of utilizing piercing punch equipment in wheel manufacture is set forth in the Daudi et al U.S. Pat. Nos. 4,279,287 and 4,354,407, both assigned to the assignee hereof, which disclose a departure from the conventional practice of attempting to form a true-running wheel. These patents addressed the problem of radial and run-out and/or radial force variations in a pneumatic tire and wheel assembly by intentionally forming the bolt-mounting and/or center-pilot openings in the wheel disc at the time of wheel manufacture on an axis which is eccentrically offset from the average axis of the bead seats on the wheel rim. This offset is in the direction and amount which is predetermined to locate the low point or high point of the first harmonic of bead seat radial run-out circumferentially adjacent to a selected location on the wheel rim. In the preferred wheel forming apparatus disclosed in the above-noted Daudi et al U.S. Patents, the bolt and center-pilot openings are formed by separate punches fixedly mounted on a single punch assembly which simultaneously punch-forms all of the openings in a wheel disc while the wheel is located by fixturing the same about the rim bead seats.

However, it has been found that a particular problem is encountered in connection with utilizing the punch-formed center pilot opening in wheel disc for fixturing the wheel assembly in manufacturing, testing and/or vehicle assembly operations performed after punching. With the punching tool hitherto conventionally in use, typically the ID of the punching hole is characterized by two contrasting peripheral surface portions: (1) a relatively smooth, cylindrical surface condition measured from the point of punch initial impact on the steel stock and extending axially in the direction of punch-through motion for a distance equal to 25 to 50% of the thickness of the material being punched; (2) the balance of the hole surface extending to the opposite face of the punched material is characterized by a "break away" configuration, i.e., a jagged or torn surface of generally frusto-conical contour diverging radially outwardly or converging radially inwardly of the hole axis in the direction of the material removal by the punch. A similar and complimentary pattern may be observed on the outer periphery or OD of the scrap piece or "slug" removed from the disc by the punch during its strike through. This punch-formed ID surface of the center pilot opening has been found to create a problem when, inter alia, the finished wheel assembly is subsequently mounted in a wheel balacing machine wherein the wheel is fixtured by a chuck collet or mandrel which engages the ID of the center pilot opening. Undesirable variations from true center mounting occurred when dealing with "true-center" wheels, probably due to insufficient true surface area on the ID of the center pilot opening as well as the irregularities in the break away portion of the ID surface.

Of course, this center pilot problem could have been overcome by employing additional machining operations after the punching operations, but at a significant cost penalty. Another approach to the solution of this problem was to employ a shearing or shaving tool operation subsequent to the punching operation, a multi-step procedure which still entailed a cost penalty.

In an attempt to reduce this cost penalty, a multi-step pierce and shave combination tool of the prior art was tested in order to punch the center hole and then follow through with an ID shaving operation with a single stepped tool using a single stroke of the punch press. This tool was formed with a typical punch nose configuration i.e., a flat end strike face perpendicular to the axis of the punch and terminating at its outer edge in a cylindrical side face which extended axially of the tool away from the end face by a distance greater than the material thickness of the disc center hole margin area. The punch shank surface terminated at a shaving shoulder, also formed perpendicular to the punch axis and extending radially outwardly from the punch shank surface to a cylindrical shaving surface having an outer diamter slightly greater than the punch shank diameter.

The shaving step shoulder performed a shaving operation on the previously punch-formed surface in order to impart a truer, more cylindrical and smoother ID to the center pilot opening.

However, this attempted solution to improving the center hole surface in turn created its own problem. It was found that the metal removed by the shaving shoulder during its strike-through formed a ring of scrap metal separate and detached from the punch slug. Although the punch slug would readily clear itself from the punch press by dropping through the scrap chute in the button retainer of the press, the shave-formed ring was found to either cling to the punch shank of the tool after the tool was retracted from the disc center hole or, if the back out stroke of the punch was operable to snag the ring on the disc hole surface, the ring would be stripped from the punch shank. The scrap ring would haphazardly drop onto the button surface and remain hung up on the punch button rather than dropping through the scrap chute. This in turn necessitated a scrap clean up operation after each center hole forming operation, with a concommittment cost penalty, and/or the possbility of tool or part damage should a scrap ring inadvertently remain in the punch apparatus.

Other prior art patents which are of interest to wheel manufacture of the type under consideration are U.S. Pat. Nos. 4,573,338; 4,646,434; 4,733,448 and 4,736,611, also assigned to the assignee hereof (which are incorporated herein by reference) and the references cited therein.

OBJECTS AND SUMMARY OF THE INVENTION

It is therefore an object of the present to provide an improved method and apparatus for manufacturing a vehicle wheel of the described type wherein the center-pilot opening is accurately and adjustably positioned with respect to the average axis of the rim bead seats, and wherein the marginal surface of the center pilot opening or hub hole between the opposite faces of the disc more closely approximates a true, cylindrical and smooth surface than that obtainable with a straight-through punch operation, thereby obviating the need for subsequently machining or otherwise subsequently treating the surface following the hole punching operation.

Another object of the invention is to provide an improved wheel manufacturing method and apparatus of the above character which accomplishes the foregoing and also is economical to implement in mass production of vehicle wheels.

A further object of the invention is to provide a wheel manufacturing method and apparatus of the above character which may be readily implemented in manufacture of true-running wheels wherein all axis and centers are nominally concentric, or the manufacturer of controlled eccentricity wheels in accordance with the above-referenced Daudi et al patents.

Yet another object of the invention is to provide an improved wheel manufacturing method and apparatus of the above character which greatly increases tool life.

In general, the foregoing and other objects are obtained in accordance with one important aspect of the present invention by a combination pierce and shave operation performed substantially concurrently on the disc material, rather than in separate and distinct stages, whereby the resulting punch-formed slug and shave-formed ring remains an integral piece of scrap, the inner periphery of the center pilot opening is more consistently formed to dimensional limits and tolerances and is characterized by a substantially cylindrical smooth hole wall extending axially of the disc between the opposite faces thereof. The inner periphery of the disc center-pilot opening is thus made more consistently to close tolerance specifications and is well adapted for use as a true mounting surface for fixturing the wheel subassembly for subsequent finishing, balancing or assembly operations.

In one preferred implementation of the invention, the disc center-pilot opening is formed in one operation by a combination pierce and shave tool wherein the shave shoulder is set back from the end face of the punch a predetermined distance less than the thickness of the disc material in the center hole region on which the pierce-shear punching operation is to be performed.

BRIEF DESCRIPTION OF THE DRAWINGS

Presently preferred embodiments of the invention, together with additional objects, features and advantages thereof, will be best understood from the following detailed description, the appended claims and the accompanying drawings (which are to scale and unless otherwise stated) in which:

FIG. 4 is a fragmentary plan view of the central portion of the disc of the wheel shown in FIGS. 1–3 after pierce-shaving formation of the center-pilot opening in accordance with the present invention.

FIG. 5 is a fragmentary cross sectional view taken on the line 5—5 of FIG. 4.

FIG. 6 is a fragmentary, part elevation, part vertical sectional view of the working end of the first embodiment of the pierce-shave tool of the invention, the center-pilot opening formed thereby, and the one-piece scrap slug removed from the disc material by the pierce-shave tool of the invention.

FIG. 7 is a view similar to FIG. 6 illustrating the working end of a prior art punch, the center-pilot opening formed thereby and the slug removed by the punch from the disc in forming the center-pilot opening in accordance with the prior art.

DETAILED DESCRIPTION OF PREFERRED EMBODIMENTS

Figure 1:
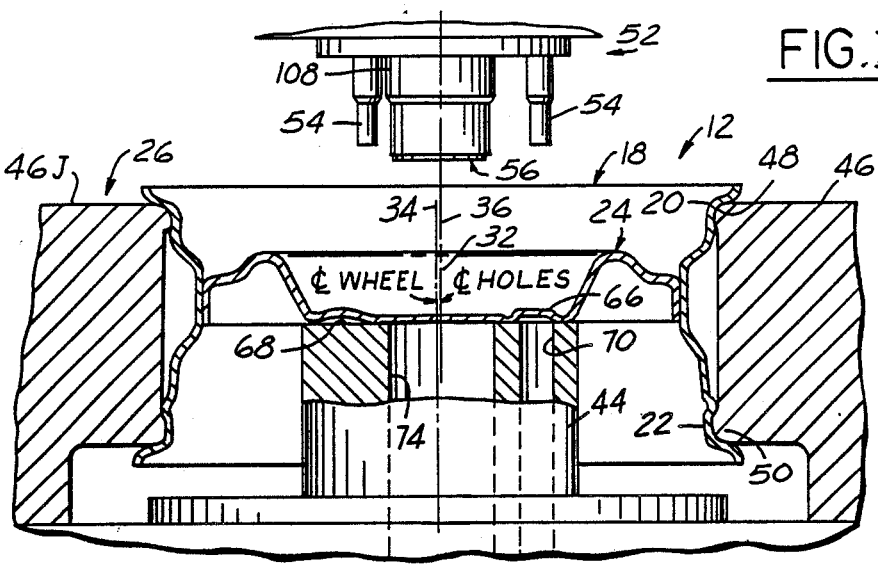
FIG. 1 is a fragmentary elevational view illustrating semischematically a punch and die fixture utilizing a first embodiment of tooling apparatus of the invention for performing the method of the present invention, portions of the apparatus being broken away and shown in center section.

Referring to FIG. 1 a typical passenger car steel wheel 12 is illustrated fixtured in a punch and die press similar to that disclosed in the aforementioned Daudi et al U.S. Pat. No. 4,279,287, which is incorporated herein by reference. Wheel 12 includes a wheel rim 18 having the usually axially spaced outboard and inboard bead seats 20 and 22 respectively, and a disc 24 carried internally of rim 18 for mounting the wheel to a vehicle. Disc 24 and rim 18 are separately manufactured to desired contour and then assembled to each other, with the disc 24 being permanently attached to the rim 18 as by press fit and welding or other joining methods. The particular rim and disc contour shown in the drawings are for illustrative purposes only and do not form part of the invention.

After the rim and disc have been assembled as described, the wheel 12 is placed in a die fixture 26 illustrated semi-schematically in FIG. 1 for the purpose of forming the disc center-pilot hole 28 (FIGS. 4, 5 and 6) and bolt holes 30. In accordance with the Daudi et al U.S. Pat. Nos. 4,279,287 and 4,354,407, the axial center line 32 of the center and/or bolt holes (preferably both) which pilot wheel 12 onto its vehicle mounting structure is eccentrically offset from the average center line 34 of rim bead seats 20, 22 by an amount 36 and in a direction emperically calculated to place the low point of the first harmonic of bead-seat radial runout adjacent a preselected location on the tire rim.

Figure 3:
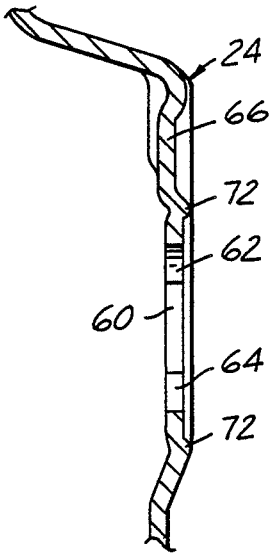
FIG. 3 is a fragmentary cross sectional view taken on the line 3—3 of FIG. 2.

The foregoing is accomplished by placing wheel 12 into die 26 such that the central "bolt-circle" portion of disc 24 rests upon the die block or "button" 44 in a predetermined angular orientation. A plurality of radially reciprocable jaws 46 (preferably twelve jaws 46A–46L as shown in FIG. 3 of U.S. Pat. No. 4,279,287) are then closed against rim 18 until upper and lower contacts 48, 50 upon each jaw 46 engage respective bead seats 20, 22. Jaws 46A–46L thus firmly clamp wheel 12 to define bead seat average center line 34, wheel 12 shifting laterally as required to accommodate the array of jaws. A punch assembly 52 having a central axis 32, a circular array of punches 54 for piercing and forming bolt holes 30 (FIGS. 4 and 5), and a center punch 56 constructed in accordance with the present invention for forming center pilot hole 28 (FIGS. 4 and 5) is then lowered against the central portion of disc 24 to pierce and form the bolt and center holes.

Figure 2:
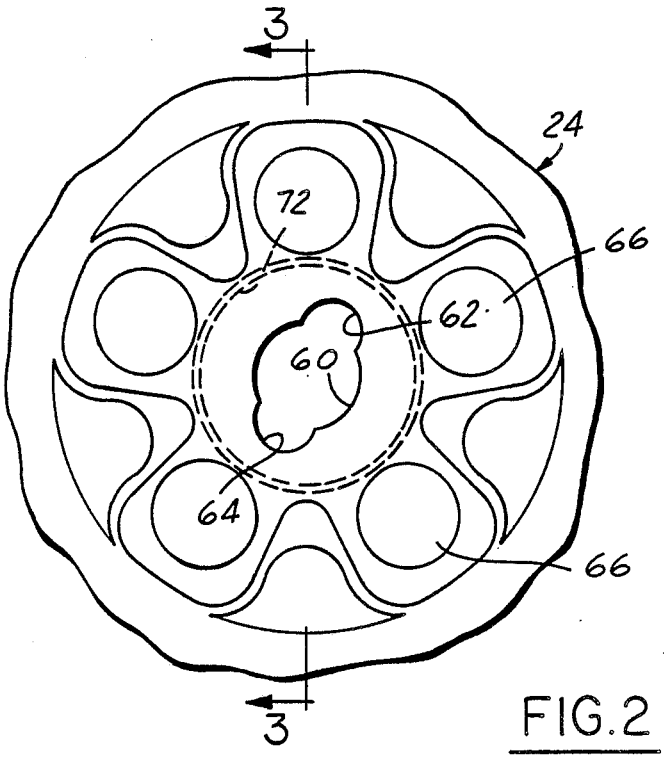
FIG. 2 is a fragmentary plan view of the center portion of the disc of the wheel assembly shown in FIG. 1 prior to pierce-shaving of the center-pilot opening in accordance with the present invention.

Of course, it is also possible to set up the punch and die apparatus to make true on-center wheels wherein axis 32 and 34 are coincident and offset 36 is zero, in accordance with the prior art to U.S. Pat. Nos. 4,279,287 and 4,354,407. It is also to be understood that disc 24 prior to being fixtured in the punch and die apparatus of FIG. 1, is stamped formed as shown in FIGS. 2 and 3 to provide the conventional bolt-circle configuration, including a conventional pierce formed oblong locator opening 60 having diametrically opposed end lobes 62 and 64. Disc 24 also has the five preformed circular flat spots 66 which are to be punched out to form the bolt holes 30 in the punch and die apparatus. When wheel 12 is fixtured in jaws 46 with the central portion of disc 24 resting upon the upper surface structure 68 of button 44, bolt circle portions 66 are individually registered with coaxially aligned drop-through chutes 70 (FIG. 1), and the center area of disc 24 within the bolt circle marginal rib 72 (FIGS. 2 and 3) is registered in coaxial alignment with a central drop-through chute 74.

Figure 8:
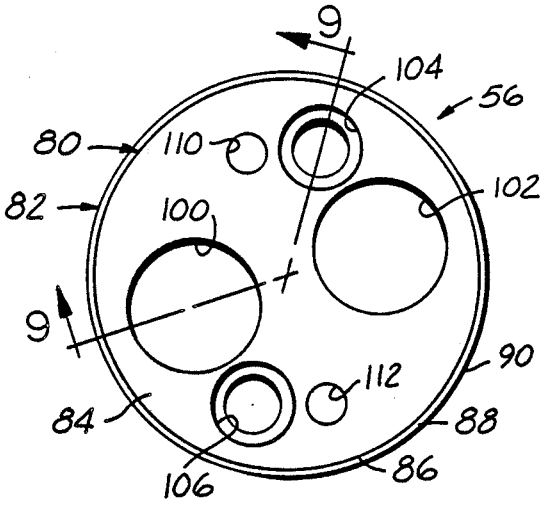
FIG. 8 is an end elevational view of the first embodiment of the pierce-shave tool of the invention.
Figure 9:
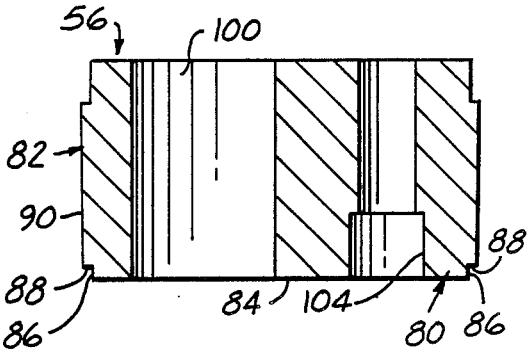
FIG. 9 is a cross sectional view taken on the line 9—9 of FIG. 8.

In accordance with a principal feature of the present invention, center punch 56 is constructed in a first embodiment shown in FIGS. 6, 8 and 9 as a combination pierce and shave tool.

Thus, as best seen in FIG. 6, punch 56 has a stepped configuration at its working end defined by a pierce portion 80 and a shave portion 82. Pierce portion 80 has a flat end face 84 perpendicular to punch axis 32 and a cylindrical side surface 86 which extends axially of the punch from face 84 to a junction with a shave shoulder face 88 which extends circumferentially continuously around the punch in a plane perpendicular to axis 32. Shoulder face 88 defines the end face of the shave portion 82 of punch 56 and extends radially from pierce shank 86 outwardly to a right angle junction with the cylindrical side surface 90 defining the shank surface of the shave portion 82 of punch 56. Shank 90 extends from shoulder face 88 at a constant diameter upwardly for the balance of the height of punch 56.

As shown in FIG. 6, shave shank 90 has a predetermined diameter "DS" substantially equal to the ultimate desired diameter of the center pilot opening 28 to be formed in the central region of disc 24. Pierce shank 86 has a diameter "DP" inset by a predetermined amount from diameter DS as established in accordance with the present invention. The axial length of pierce shank 86, constituting the set back distance "SB" between pierce end face 84 and shave shoulder face 88, is also a predetermined dimension which, in accordance with the present invention, is a function of the material thickness "MT" of the steel plate stock of disc 24 within the bolt circle rib 72, i.e., the stock thickness which will define the margin of the center pilot opening 28 to be formed in disc 24.

The remaining structure of the combination pierce and shave punch 56 is generally conventional and is illustrated in FIGS. 8 and 9. Punch 56 thus has a pair of through bores 100 and 102 which individually receive associated locator pins (not shown) adapted to protrude below the end face 84. These locator pins have tapered exposed shanks which individually engage the margins of lobes 62 and 64 of locator opening 60 during punch decent and thus insure final accurate angular orientation of wheel 12 in die 26 prior to piercing of the bolt and center openings. Punch 56 also has a pair of counterbored through openings 104 and 106 adapted to individually receive threaded mounted studs for removably securing punch 56 to the punch holder 108 of punch assembly 52 (FIG. 1). Another pair of throughbores 110 and 112 (FIG. 8) extend through punch 56 for slidable reception of a pair of ejector pins (not shown) which are spring biased to yieldably protrude beyond or below end face 84 to serve as slug knock-off pins.

In the operation of the apparatus of the invention in performing the method of the invention as thus far described, it will be seen that during decent of punch 56 on the working stroke of punch assembly 52, end face 84 of piercing portion 80 will first strike the upper face 114 of disc 24 and then compress and push the metal of the disc located in the path of face 84 downwardly as viewed in FIG. 6. This initiates a piercing type operation in which the outer boundry of the metal being moved tends to shear for a small distance downwardly from face 114 and then break out with a tearing action when the impact forces greatly exceed the shear strength of the material. However, before complete separation of the scrap slug can occur in the punch down-stroke, shave shoulder face 88 strikes the material of the disc surrounding pierce shank 86 to initiate a shave shearing action in this thin band or ring-like zone of material. Break out of the slug then occurs, as shear face 88 of punch 56 reaches disc bottom face 116 during its downstroke as viewed in FIG. 6. The downstroke terminates after shave shank 90 completes full penetration of disc 24 and shoulder face 88 has passed downwardly beyond the bottom face 116 of disc 24, thereby completing a shaving and smoothing action on the inner peripheral surface 118 of center pilot opening 28. It has been found that the wall 118 defining center pilot opening 28 as thus formed is substantially cylindrical, smooth and consistently holds a close tolerance as to location and diameter. The slug 120 (FIG. 6) produced by tool 56 is characterized by a concave geometry at the upper face 122 of the slug and a convex geometry at the slug under face 124. A flat, ring-like surface 126 is visible as a margin around surface 122 and is bounded by a ring-like upward protrusion 128 extending upwardly to an edge 130 which lies in a plane perpendicular axis 32. The outer periphery of slug 120 is characterized by a smooth, polished-like band 132 extending from the outer edge of bottom face 124 upwardly about a third of the height of the slug. The peripheral face 134 extending upwardly from smooth face 132 to upper edge 130 is tapered slightly inwardly radially of the slug and is rougher in surface texture.

For purposes of comparison of the method and apparatus of the invention with the commercial prior art previously employed in this wheel manufacture, reference may be made to FIG. 7 in which a prior art pierce punch 140 is employed to pierce a center opening 28' in a disc 24' (like reference numerals raised by a prime suffix being utilized to indicate elements corresponding to those previously described). Punch 140 has a flat end face 142 and a cylindrical shank surface 144 of constant diameter, with no shaving or other step shoulder such as that which characterizes the tool 56 of the present invention. Punch 140, like punch 56, is operated in a continuous down stroke to strike and punch through disc 24' in a conventional piercing action. The result, as illustrated in FIG. 7 with respect to mild steel material, is a center pilot opening 28' characterized by a smooth shiny sheer surface 146 which extends from the upper face 114 downwardly about 25% to 50% of the stock thickness. Balance of the center pilot opening surface 148 is characterized as a "break-away" surface commonly seen in conventional piercing operations, the same being evidence of a tearing action of the metal and, for example, diverging radially outwardly in the direction of punch travel as shown in FIG. 7. The slug 150 of the prior art piercing operation is slightly bowed in a downward direction and is characterized on its outer periphery by corresponding smooth shear surface 146' and a jagged tear or break away surface 148' extending upwardly from surface 146' to the upper edge 152 of slug 150. When dealing with HSLA steel and concast steel, the break away surface 148 of opening 28' typically tapers so as to converge radially inwardly in the direction of punch travel. It will thus be seen that the prior art center pilot opening 28' thus formed provides a less than desirable locating or fixturing surface for wheel 12 in operations requiring such center pilot mounting subsequent to the bolt and center opening piercing operation on the wheel.

Figure 10:
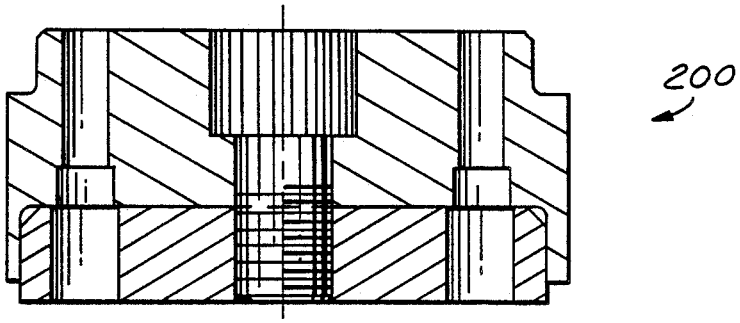
FIG. 10 is a center cross sectional view of a second embodiment of a pierce-shave tool of the invention.
Figure 11:
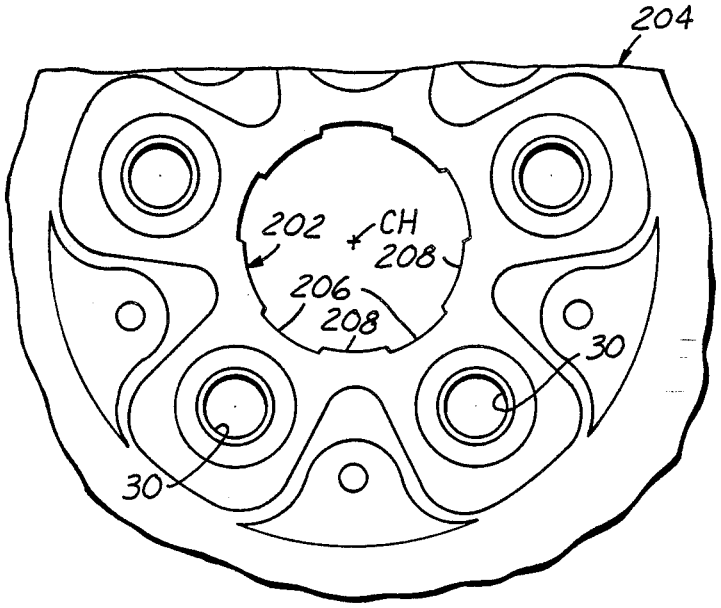
FIG. 11 is a fragmentary plan view of the central portion of a wheel disc with a center pilot opening formed by the modified tool of FIG. 10.

Referring to FIGS. 10 and 11, a second embodiment of a combination pierce and shave punch 200 construction in accordance with the present invention is illustrated (FIG. 10) for forming a so-called "scalloped" center pilot opening 202 (FIG. 11) in a wheel disc 204 otherwise identical to disc 24 described previously. As set forth in the aforementioned Daudi U.S. Pat. No. 4,573,338, with reference to FIG. 6 therein, in some instances the center pilot opening 202 preferably comprises a circumferentially alternating series of radially spaced arcuate segments, with an outer segment 206 being radially aligned with the associated bolt hole opening 30. The center hole axis CH is effectively defined by the inner segments 208, so that distortion of outer segments 206 caused by coining of the bolt holes 30 will not distort inner segments 208 to thereby avoid altering or repositioning the center hole axis.

Modified tool 200 is constructed to achieve this scalloped center pilot opening while also employing the principles of the invention relative to the inner peripheral surfaces of inner segments 208 which together define the interrupted center pilot wheel mounting surface of disc 204. Punch 200 is preferably made in two pieces consisting of a pierce punch part 210 and a shave-pierce punch 212. Pierce punch 210 comprises a cylindrical disc having a flat end face 214 perpendicular to axis 32 and a cylindrical outer peripheral surface 216 of constant diameter equal to DP of punch 56. Pierce punch 210 nests snuggley in a pocket 218 of pierce-shave punch 212 and is detachable secured thereto by a threaded cap screw (not shown) received in a counterbored through-passage 220 in part 212 and threaded into a threaded through passage 222 in part 210. Part 212 in turn is detachably threadably secured to the punch holder 108 by means of cap screws (not shown) received in counterbores 224 and 226 of part 212. Part 210 is provided with a pair of throughopenings 228 and 229 registering with counterbores 224 and 226 to provide access to the cap screws.

Lower face 230 of part 212 is a flat planar surface disposed perpendicular to axis 32 and set back from face 214 by the aforementioned distance SB, as in punch 56. However, the outer periphery of part 212, unlike shank surface 90, is scalloped as viewed in plan view complimentarily to the scalloped configuration of pilot opening 202. Punch 212 thus has circumferentially alternating and radially offset thick and thin (radially) lands 232 and 234 with segmental cylindrical side surfaces 236 and 238 respectively. Surfaces 238 match the inner peripheral surfaces of the inner segments 208 of the pilot opening, whereas surfaces 236 match the inner peripheral surfaces of the outer segments 206 of opening 202. The interrupted cylinder containing surfaces 238 has a diameter substantially equal to the diametrical dimension DS of punch 56. The set back distance SB of face 230 relative to face 214 again is substantially equal to that set forth with respect to punch 56.

In operation of the two part pierce and shave punch 210-212, the relationship of the shallow lands 234 to pierce punch 209 causes the surfaces 208 to be formed in the manner of the inner peripheral wall surface 118 of pilot opening 28. Due to the diameter of the interrupted cylinder containing surfaces 236 of the deeper lands 232 exceeding the aforementioned preferred diametrical difference between the dimensions DS and DP, the surfaces 206 will not have the desired finish and geometry to serves as mounting surfaces. However, this is not a detriment inasmuch as these surfaces do not serve as subsequent locating, mounting or pilot surfaces with respect to subsequent wheel manufacturing, testing or assembly operations.

It is also to be understood that making tool 200 in two pieces is preferable to the one piece construction of tool 56 because it greatly facilitates sharpening of the tool. For this purpose, part 210 is demounted from part 212 and face 214 suitably reground to provide a sharp edge at the junction of face 214 with the periphery 216. Likewise, part 212 with part 210 demounted may be readily sharpened by regrinding face 230 to sharpen the junction of the same with the shaving lands 238. It is also to be understood that punch 56 may likewise be constructed in two pieces similar to punch 200 to facilitate sharpening and replacement of the shave punch parts.

Although the aforementioned explanation of the theory of operation of the method and apparatus of the present invention as best presently understood remains speculative test results available to date on a range of MT from about 0.130 inches to about 0.205 inches indicate that the dimension SB is fairly critical, and that the same is a function of the dimension MT, whereas the inset dimension, representing the diametrical difference between the diameter DS of shave 82 minus the diameter DP of punch 80, is substantially a constant which does not vary with either the material thickness MT within the aforementioned range or the diameter of the center pilot opening 28 (substantially DS). In tests performed on pierceable steel alloys such as aluminum killed mild steel, as well as HSLA steel, good results in accordance with the foregoing improved results of the invention were obtained as follows:

EXAMPLE 1

A one-piece, unscalloped punch constructed in accordance with the aforementioned description of punch 56 of FIGS. 6, 8 and 9 was emperically designed through iteration for a material thickness (MT) of 0.180 inches for both mild steel and HSLA disc material. This punch had a DS dimension of 2.2465 inches and a DP dimension of 2.186 inches resulting in a diametrical inset difference of 0.0605 inches, to produce a center pilot opening 28 having a diameter of 2.2480 inches. The SB dimension of this example was 0.064 inches, which represents about 36% of the MT dimension.

EXAMPLE 2

A punch constructed pursuant to the two piece punch 200 of FIG. 10 for working on a disc HSLA and concast steel material having an MT thickness of 0.195 inches had a dimension DP of face 216 of 2.707 inches, and the diameter of the interrupted cylinder containing surfaces 238 of the shave lands 234 was 2.767 inches, resulting in an inset diametrical difference of 0.060 inches. The set back distance SB between face 214 and face 230 was 0.070 inches, which again is about 36% of the MT dimension. The diameter of the circle containing inner periphery of inner segments 208 formed by the punch 200 of this Example was 2.7685 inches.

EXAMPLE 3

Another two-piece punch constructed in accordance with the disclosure of punch 200 FIG. 10 was designed for a mild steel disc material having an MT thickness of 0.200 inches. The DP dimension was 2.996 inches, and the circle diameter DS containing surfaces 238 was 3.0680 inches, for a diametrical inset difference of 0.072 inches. The SB dimension was 0.072 inches, or again about 36% of the MT dimension. The diameter of the circle containing the inner periphery of inner segments 208 of this Example was 3.0695 inches.

Examples 1, 2 and 3 performed well and provided the improved surface finish of the center pilot hole mounting surfaces, whether of the continuous or interrupted type described previously. The slugs resulting from Examples 1, 2 and 3 were substantially similar in their characteristics and comported with that described above with respect to slug 120. The Rockwell (Rb) hardness for these materials was typical for punch piercing operations, i.e., in the sixties for mild steels and in the seventies and eighties for HSLA steels. No separate ring was formed by the pierce-shaving operation, a one piece slug being obtained which upon strip-off or knock-off would drop through the scrap chute 74 with no problem of hang-up.

By contrast, the following examples were found not to be satisfactory to achieve the objects and results and advantages of the present invention:

EXAMPLE 4

A one piece punch similar to punch 56 described previously was constructed having a DS dimension of 2.244 to 2.247 inches and a diametrical inset difference (DS-DP) of 0.060 inches. However, the SB dimension was 0.125 inches. The MT dimension was nominally 0.200 inches. The disc material was HSLA steel with an Rb in the seventies or about eighty. This punch operated to produce the slug 150 with a small shear surface 146′ followed by a complete break-away surface 148′. This pierce and shave punch design then operated to shave the hole diameter, which resulted in a clean hub hole diameter with a smooth peripheral wall, no burrs and good control of hole diameter. However, the problem with this design was that it left a second scrap piece consisting of a ring approximately 0.020 inches thick. This separate scrap ring sometimes did not completely separate from the wheel disc 24, and at other times stripped from the punch and became hung up on the top surface of the button retainer 44.

EXAMPLE 5

A pierce and shave punch was designed pursuant to the description of punch 56 except for the controlling dimensions. This punch design had the same DS dimension as Example 4 but an inset diametrical difference dimension (DS-DP) of 0.120 inches. A SB dimension of 0.070 inches was provided. The disc material was the same as in Example 4. This punch operated to produce a shear and break away condition in the center pilot opening, and did leave a burr. The center pilot opening diameter could not be controlled with this punch. Moreover, the break away surface was tapered radially inwardly in the direction of punch travel. This resulted in the center pilot hole having a smaller diameter at the break away than at the shear portion. Thus, although a one piece scrap part was produced, the operation of this punch was clearly unsatisfactory toward achieving the objects of the present invention.

From the foregoing description, it now will be understood that the improved method and apparatus of the present invention amply fulfills the aforestated objects and provides several advantages over the prior art. Whereas the prior art tool 140 requires removal for sharpening after about twenty four hours of continuous duty cycling, the tools 56 and 200 of the present invention were found not to require sharpening until after some two weeks of continuous duty cycling had been performed by the tool. This equates approximately to a fourteen-fold increase in tool life. In addition, the tolerances of the center pilot openings produced by these tools were more consistently maintained for a much longer period of time than was the case with the prior art tool, resulting in less scrap discs.

As indicated previously, the peripheral wall surface 118 of the center pilot opening 28 was much smoother and more closely approached a true cylinder than was the case with the pilot opening 28' produced by the prior art punch 140. By making the combination pierce and shave punch of the invention as a two-part punch 200, the same is essentially as easy to sharpen as the prior art punch 140. The problem of producing both a slug and separate scrap ring was eliminated with both embodiments 56 and 200 of the invention. The principles of the pierce and shave punch of the invention are applicable to both scalloped and circumferentially continuous center pilot openings as described above.

It is to be understood that in the aforementioned Examples 1–5 the conventional punch press equipped with die fixture 26 and punch assembly 52 was a Berson punch press having a 300 ton capacity. This press was operated at about 30% of press tonnage capacity at an operating rate of eighteen strokes per minute. However, it has also been found that the improved results of the present invention can also be obtained utilizing a 1600 ton capacity Danly punch press operating at twelve strokes per minute.

Although the inset diametrical difference DS-DP was found to be a relatively constant measurement within the aforementioned MT range of 0.130 to 0.205 inches, it is believed that this measurement will also remain the same as previously specified for materials having an MT dimension greater than the aforesaid upper limit. However, for thinner materials having an MT less than 0.130 inches, it is also believed that the DS-DP measurement will have to be reduced by emperical try-out to achieve the aforesaid improved results. For example, for an MT of 0.080 inches, a DS-DP of 0.030 inches would, it is believed, produce good results.

It is also to be understood that the bolt hole punches 54 could likewise be modified into the stepped configuration of the combination pierce and shave punch of the present invention if desired to improve the finish, geometry and consistency of the bolt holes 30. However, in most instances, these bolt holes are designed with a clearance for the associated wheel mounting studs (lug nuts) and a coined chamfer or bevel is imparted to the margin on the outboard face of the wheel disc encircling the bolt holes which is controlled to mate with the frusto-conical surface of the wheel lug nuts. Hence, bolt hole bore surfaces are not normally considered to be critical with respect to dimensional tolerances, finish or geometry.

It has also been found that employing the method and apparatus of the present invention has greatly reduced or eliminated the minute stress cracks typically found to be present around the margin of the prior art center pilot opening 28'. This improvement in turn is believed to result in improved fatique life of steel wheels with punch-formed openings made by the method and apparatus of the present invention.

Within the parameters described previously, it is also believed that the invention may have wide application to other hole piercing operations in metal forming arts. Therefore the invention should not be considered limited to the preferred embodiments described above and shown in the drawings but can be modified in various ways by those skilled in the art having the benefit of the above disclosure within the scope of the appended claims and the applicable prior art.

I claim:

1. A method of punch forming a through-opening in a pierceable metal blank having a stock thickness MT measured axially of said opening in a margin material which surrounds said opening after the same has been formed, said blank having first and second opposite faces and said opening extending therebetween, said opening having a predetermined finished inner peripheral dimension DS defined by inner peripheral wall surface means in said margin material extending circumferentially of said opening between said first and second blank faces, said method comprising the steps of:

(1) providing pierce punch means having a working end face transverse to the axis of said pierce punch means and shank surface means intersecting said pierce end face having an outer peripheral dimension DP smaller by a predetermined amount than DS, (2) providing shave punch means having a working end face transverse to the axis of said shave punch means and shank surface means intersecting said shave end face and having an outer peripheral dimension DS and an inner peripheral dimension DP, (3) operating said pierce punch means in a working stroke with its axis aligned coaxially with said opening axis to cause said pierce working end face to strike said first blank face and then move through said blank material past said second blank face, (4) operating said shave punch means in a working stroke with its axis aligned coaxially with said opening axis to cause said shave working end face to strike said first blank face after said pierce end face has has traveled a predetermined distance SB from said first face toward said second face and to then move through said blank material past said second blank face in trailing relation to said pierce end face, and (5) correlating the dimension DS, DP and SB with one another relative to dimension MT to cause said pierce and shave punch means to cojointly punch out a one-piece scrap slug to thereby form said opening with an inner peripheral wall surface having a generally smooth and generally cylindrical contour at said DS dimension.

2. The method as set forth in claim 1 wherein said dimension MT is in the range of about 0.250 inches to about 0.130 inches, said dimension SB is in the range of about 34 to 36% of MT, and said dimension DS is greater than said dimension DP by an amount in the range of about 0.050 to about 0.060 inches.

3. The method as set forth in claim 2 wherein said dimension SB is about 36% of said dimension MT.

4. The method as set forth in claim 3 wherein said pierce punch shank surface is an uninterrupted cylindrical surface.

5. The method as set forth in claim 4 wherein said shave punch shank surface is an uninterrupted cylindrical surface coaxial with said pierce punch shank surface.

6. The method as set forth in claim 4 wherein said shave punch shank surface defines an interrupted cylindrical surface defining radially shallow lands, said shave punch means having radially deep lands protruding radially outwardly beyond said shallow lands and alternating circumferentially with said shallow lands.

7. A method forming a through-opening in a disc vehicle wheel having a rim with a tire bead seat region and a pierceable metal wheel disc blank preform mounted internally of said rim, said disc blank having a stock thickness MT measured of said opening in a margin material which surrounds said opening after the same has been formed, said blank having first and second opposite faces and said opening extending therebetween, said opening having a predetermined finished inner peripheral dimension DS defined by inner peripheral wall surface means in said margin material extending circumferentially of said opening between said first and second blank faces, said method comprising the steps of:

(1) providing pierce punch means having a working end face transverse to the axis of said pierce punch means and shank surface means intersecting said pierce end face having an outer peripheral dimension DP smaller by a predetermined amount than DS, (2) providing shave punch means having a working end face transverse to the axis of said shave punch means and shank surface means intersecting said shave end face and having an outer peripheral dimension DS and an inner peripheral dimension DP, (3) operating said pierce punch means in a working stroke with its axis aligned coaxially with said opening axis to cause said pierce working end face to strike said first blank face and then move through said blank material past said second blank face, (4) operating said shave punch means in a working stroke with its axis aligned coaxially with said opening axis to cause said shave working end face to strike said blank face after said pierce end face has has traveled a predetermined distance SB from said first face toward said second face and to then move through said blank material past said second blank face in trailing relation to said pierce end face, and (5) correlating the dimension DS, DP and SB with one another relative to dimension MT to cause said pierce and shave punch means to cojointly punch out a one-pierce scrap slug to thereby form said opening with an inner peripheral wall surface having a generally smooth and generally cylindrical contour at the said DS dimension.

8. The method as set forth in claim 7 wherein said dimension MT is in the range of about 0.250 inches to about 0.130 inches, said dimension SB is in the range of about 34 to 36% of MT, and said dimension DS is greater than said dimension DP by an amount in the range of about 0.050 to about 0.060 inches.

9. The method as set forth in claim 8 wherein said dimension SB is about 36% of said dimension MT.

10. The method as set forth in claim 9 wherein said pierce punch shank surface is an uninterrupted cylindrical surface.

11. The method as set forth in claim 10 wherein said shave punch shank surface is an uninterrupted cylindrical surface coaxial with said pierce punch shank surface.

12. The method as set forth in claim 11 wherein said MT dimension is about 0.180 inches, said DS dimension is about 2.246 inches, said DP dimension is about 2.186 inches and said SB dimension is about 0.064 inches.

13. The method as set forth in claim 10 wherein said shave punch shank surface defines an interrupted cylindrical surface defining radially shallow lands, said shave punch means having radially deep lands protruding radially outwardly beyond said shallow lands and alternating circumferentially with said shallow lands.

14. The method set forth in claim 13 wherein said MT dimension is about 0.195 inches, said DS dimension is about 2.767 inches, said DP dimension is about 2.707 inches and said SB dimension is about 0.070 inches.

15. The method set forth in claim 13 wherein said MT dimension is about 0.200 inches, said DS dimension is about 3.068 inches, said DP dimension is about 2.996 inches and said SB dimension is about 0.072 inches.

* * * * *